US006756876B2

(12) United States Patent
Sullivan et al.

(10) Patent No.: US 6,756,876 B2
(45) Date of Patent: Jun. 29, 2004

(54) CIRCUIT INTERRUPTER AND METHOD

(75) Inventors: Steven K. Sullivan, Cranston, RI (US); Karl A. Kohm, Cranston, RI (US); Kevin R. French, North Dighton, MA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/210,688

(22) Filed: Aug. 1, 2002

(65) Prior Publication Data

US 2003/0058079 A1 Mar. 27, 2003

Related U.S. Application Data

(60) Provisional application No. 60/324,494, filed on Sep. 24, 2001.

(51) Int. Cl.[7] ..... H01H 37/52

(52) U.S. Cl. ..... 337/111; 337/379; 337/365; 337/102

(58) Field of Search ..... 337/53, 85, 89, 337/102, 107, 111, 112, 333, 379, 362, 365, 377, 380

(56) References Cited

U.S. PATENT DOCUMENTS 3,196,233 A * 7/1965 Burch et al. ..... 337/94
3,430,177 A * 2/1969 Audette ..... 337/365
3,443,259 A * 5/1969 Wehl et al. ..... 337/89
3,622,930 A * 11/1971 D'Entremont ..... 337/107
3,670,283 A * 6/1972 Holden ..... 337/354
3,959,762 A * 5/1976 Senor ..... 337/102
4,015,229 A * 3/1977 Senor et al. ..... 337/107
4,136,323 A 1/1979 D'Entremont et al.
4,167,721 A * 9/1979 Senor et al. ..... 337/112
4,224,591 A * 9/1980 Senor ..... 337/102
4,236,135 A * 11/1980 Holden ..... 337/89
4,399,423 A * 8/1983 Nield ..... 337/102
4,476,452 A * 10/1984 D'Entremont ..... 337/102
4,490,704 A * 12/1984 Snider et al. ..... 337/372
4,517,541 A * 5/1985 Ubukata et al. ..... 337/89
4,521,760 A * 6/1985 Carbone et al. ..... 337/368
4,823,105 A * 4/1989 Givler ..... 337/368
5,268,664 A * 12/1993 Givler ..... 337/380
5,402,099 A * 3/1995 Ballard et al. ..... 337/298
5,808,539 A * 9/1998 White ..... 337/379
6,020,807 A * 2/2000 Givler ..... 337/377
6,483,418 B1 * 11/2002 Reno et al. ..... 337/379

* cited by examiner

*Primary Examiner*—Anatoly Vortman
(74) *Attorney, Agent, or Firm*—Russell E. Baumann; Frederick J. Telecky, Jr.

(57) ABSTRACT

A current interrupter (10, 10') includes bimetallic member (18) as a switching member having a formed portion (18*a*) providing snap action movement between oppositely dished configurations. An integrally formed extended length portion (18*b*) having a stiffening feature extends from the formed portion and mounts a movable contact at its free end. Stiffening feature embodiments include folded opposed marginal edges and one or more longitudinally extending ribs formed in the extended length portion. In one embodiment, the bimetallic member is cantilever mounted in a housing member (14). In another embodiment, a bimetallic member (18D) has first and second extended length portions (18*b*) extending from opposite sides of a formed portion to provide a circuit interrupter with a double break system.

22 Claims, 8 Drawing Sheets

CIRCUIT INTERRUPTER AND METHOD

This application claims priority under 35 USC Section 119 (e) (1) of provisional application Ser. No. 60/324,494, filed Sep. 24, 2001.

FIELD OF THE INVENTION

This invention relates generally to circuit interrupters and more particularly to circuit interrupters in an automotive environment in which the electrical system operating voltage has been elevated above the conventional 14 Vdc, for example to 42 Vdc, in order to meet future power demands.

BACKGROUND OF THE INVENTION

Circuit interrupter devices for electrical motors are commonly connected in motor winding circuits to respond to overload currents which result when certain fault conditions occur, thereby to interrupt the high currents which would tend to cause rapid overheating of the motor windings. It is also desirable to arrange such devices to be directly responsive to increases in winding temperature to interrupt the winding circuits to protect the windings against relatively slower build-up of winding temperatures.

Circuit interrupt devices conventionally used for automotive applications typically comprise a generally flat open-ended electrically conductive metal can which has a flange around its open end. A generally flat, electrically conductive metal lid is attached to and electrically isolated from the open end of the can by an electrically insulating gasket which fits between the lid and the can flange. A thermally responsive bimetallic member has one end welded or otherwise secured to the inside surface of the bottom of the can. The bimetallic member extends in cantilever relation from the can bottom and carries a movable contact at its distal end, the member being adapted for snap-acting movement between two opposite configurations in response to temperature change to engage and disengage the movable contact with a stationary contact mounted on the inner surface of the lid thereby to open and close an electrical circuit between device terminals extending from the can and lid. It is also common that such motor protectors incorporate a heating element of selected electrical resistance material to be energized by current passing through the protector for heating the bimetal, along with heat generated in the bimetallic member itself. One such arrangement includes a lid member which is separated into two parts spaced from one another and with an end of the heater element connected to each part. In addition to providing desired current sensitivity the heating element aids in maintaining the bimetallic member above its reset temperature for an extended period of time so that the protector device is adapted to cycle on and off at a relatively slow rate while the fault condition causing the overload current persists and aids in providing a relatively long service life.

Circuit interrupters as described above presently used in automotive applications have been designed for operation at 16 Vdc during locked rotor conditions. The contact gaps provided in such protectors are insufficient to interrupt the electric arc generated at the proposed voltage and ampere levels which would cause the contacts to melt across the open gap as the bimetallic member attempts to interrupt the circuit. The welded contact interface would sustain locked rotor conditions and permit a hazardous high temperature condition to be created within the motor.

Conventional protective devices as described above have been designed to function at ampere levels between 45 and 4 amps at 14 Vdc for applications such as windshield wiper, window lift and seat adjusting motors. Increasing the electrical supply system to 42 V would reduce these values by a factor of three, producing lock rotor ampere ratings between 15 and 1.3 amps at 42 Vdc for these same applications. The electrical resistance needed to produce the $I^2r$ heating necessary to heat the device to its actuation temperature would increase generally by a factor of nine. Merely increasing the size of the bimetal member to produce the required contact gap is not suitable because this would reduce current sensitivity and result in an increased product envelope causing assembly problems due to the limited space available for protectors in motor housings, particularly in the automotive environment.

SUMMARY OF THE INVENTION

An object of the present invention is the provision of an improved circuit interrupter having sufficient contact gap to interrupt the arc in an elevated electrical supply system while achieving current sensitivity at a fraction of the ampere levels of conventional protective devices while at the same time maintaining a small envelope for the device. Another object of the invention is to provide an improved motor protector for use in protecting relatively small electrical motors which is reliable, low in cost and one which has a relatively long service life.

Briefly described, a circuit interrupter made in accordance with a first preferred embodiment of the invention comprises a bimetallic member having a motion amplifying extended length portion extending from a dished shaped portion for providing snap action of the member between two oppositely configured positions and a movable contact at a free end of the extended length portion adapted to move into and out of electrical engagement with a stationary contact. The extended length portion includes a stiffening feature to minimize the portion's displacement associated with the bimetal member's flexivity and normal temperature variation. The stiffening feature increases the mechanical spring rate of the bimetallic member thereby promoting larger snap acting displacement characteristics which otherwise would be lost to mechanical wind-up and results in an optimization of the slope of the calibration curve.

The stiffening feature may take one or more of several forms including folding the outer edge of the extension portion relative to a plane in which the remainder of the extension portion lies, for example, by 90° or 180° thereto, longitudinally extending rib or ribs formed in the extended length portion and forming the extended length portion with one or more cut-out portions which also increases current sensitivity of the bimetallic member. The extended length portion may have a generally uniform width extending from the dished portion to the movable contact or it may be tapered so that the width narrows in the direction going from the dished portion to the movable contact. In certain embodiments the width of the extended length portion at the dished portion is wider than the generally circular dished shaped portion. In a preferred embodiment, each side of a tapered width extended length portion is generally tangent to the generally circular dished shaped portion.

The bimetallic member of at least certain ones of the preferred embodiments is formed with another extended length portion for attachment of the bimetallic member in a housing and according to a preferred embodiment this portion is also provided with a stiffening feature comprising opposed folded edge portions of the bimetallic member to further minimize mechanical wind-up and thermal creep thereby increasing snap-open gap and increasing resonant frequency to avoid loss of continuity during vibration exposure.

In another preferred embodiment, the bimetallic element has an extended length portion including a stiffening feature which extends from the dished shaped portion in two opposite directions, each with a movable electrical contact which is adapted to move into and out of electrical engagement with a respective stationary electrical contact mounted in a housing. The dished shaped portion may be provided with a centrally disposed aperture which receives a mounting member therethrough for mounting the member in the housing.

BRIEF DESCRIPTION OF THE DRAWINGS

Other objects, advantages and details of the novel and improved circuit interrupter device of this invention appear in the following detailed description of preferred embodiments of the invention, the detailed description referring to the drawings in which.

DETAILED DESCRIPTION OF THE PREFERRED EMBODIMENTS

Figure 1:
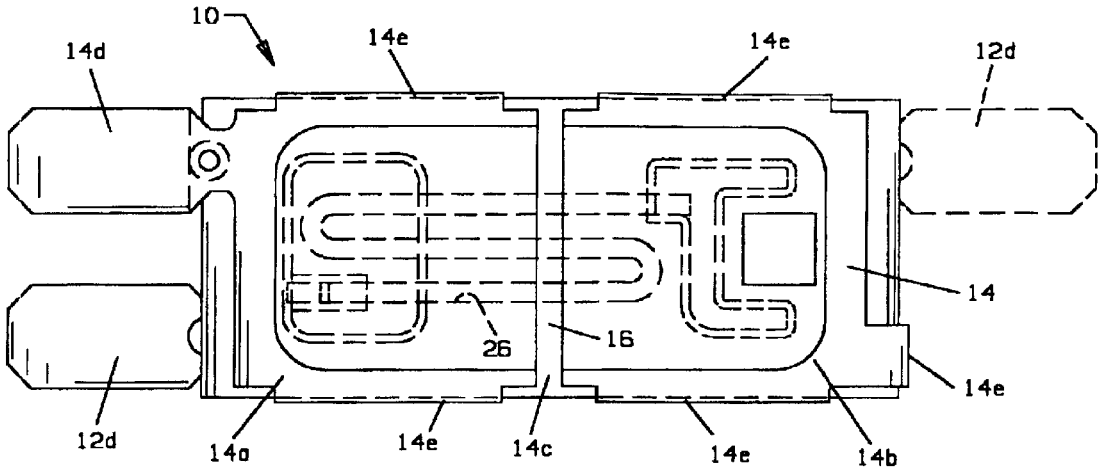
FIG. 1 is a top plan view of a circuit interrupter made in accordance with a first embodiment of the invention.
Figure 2:
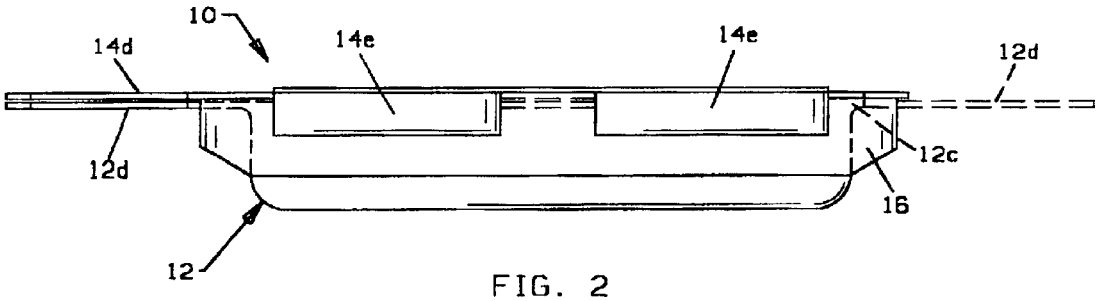
FIG. 2 is a front elevational view of the FIG. 1 interrupter.
Figure 3:
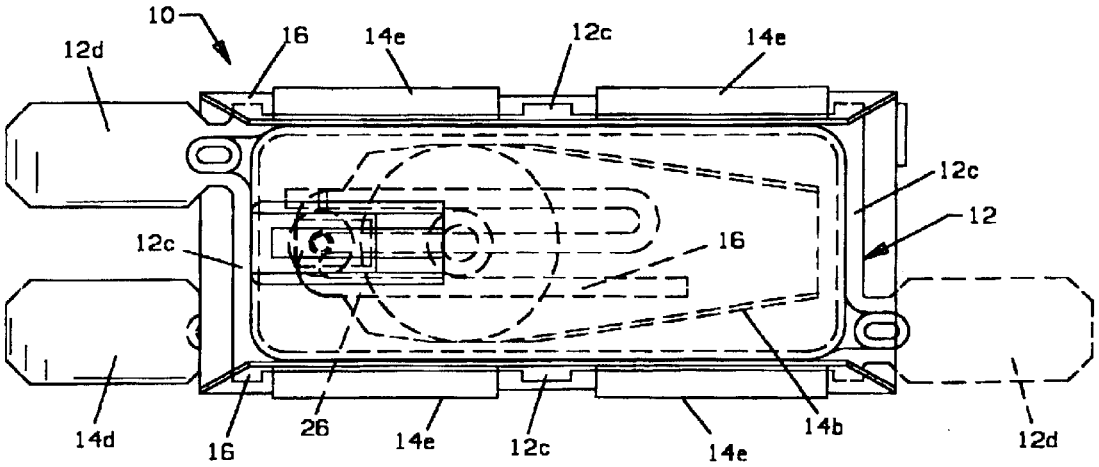
FIG. 3 is a bottom plan view of the FIG. 1 interrupter.

With reference to FIGS. 1–6, a circuit interrupter 10 made in accordance with a first embodiment of the invention comprises a metal, electrically conductive housing member 12 in the form of an open ended can having a bottom wall 12*a*, side walls 12*b* and outwardly extending flange portions 12*c* for receipt of a lid 14 and electrically insulative layer 16 to be described. Electrically conductive terminal 12*d* is shown projecting from housing 12 and another terminal 14*d* is shown projecting from lid 14. An alternate position for terminal 12*d* is shown in dashed lines.

Lid 14 is formed in two members 14*a*, 14*b* separated from each other at 14*c* to facilitate placement of a heater element to be described. Lid members 14*a*, 14*b* are provided with tabs 14*e* which are bent over to clamp housing member 12. As noted above, a layer of suitable electrically insulative material 16 is placed between the housing member and the lid members to provide electrical isolation therebetween with suitable apertures provided therein for placement of stationary contacts and heater elements to be described.

Figure 5:
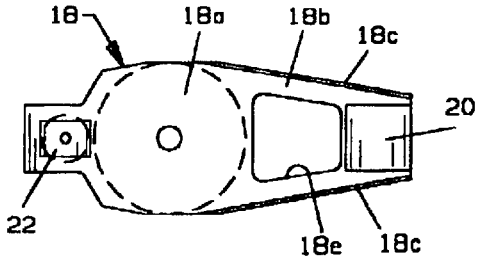
FIG. 5 is a top plan view in reduced scale of one form of a bimetallic member used in the FIG. 1 interrupter.
Figure 6:
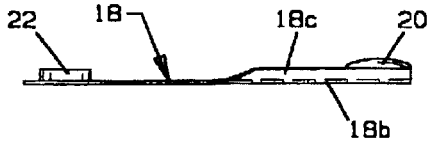
FIG. 6 is a front elevational view of the FIG. 5 bimetallic member.
Figure 14A:
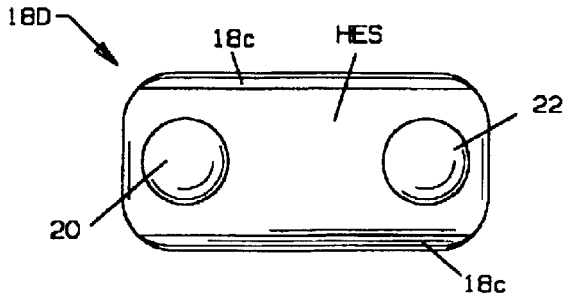
FIGS. 14*a*–14*c*; 14*d*–14*f*; 14*g*–14*i*; 14*j*–14*l* and 14*m*–14*o* show modifications of the stiffening feature of the bimetallic members 18D, 18E, 18F, 18G and 18H respectively, useful in the circuit interrupter of the invention.
Figure 14B:
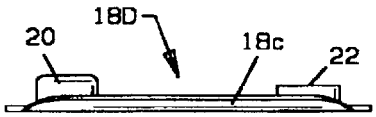
Figure 14C:
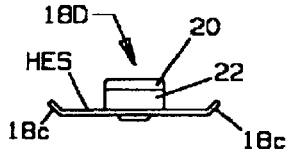

A member 18 formed of suitable thermostatic material, such as bimetal, is mounted in housing member 12 to serve as a switching member. As shown in FIGS. 5 and 6, bimetallic member 18 has a formed portion 18*a* for providing snap action motion between oppositely dished configurations in dependence upon temperature in a known manner. The bimetallic member is elongated by means of an extended length portion 18*b* extending from formed portion 18*a* and has a free end which mounts a movable electrical contact 20. Extended length portion 18*b* serves to amplify the displacement created by formed portion 18*a* and includes a stiffening feature to minimize the portion's thermal displacement associated with the bimetal member's flexivity and normal temperature variation and to promote larger snap action displacement characteristics which would otherwise be lost to thermal creep. In addition, the stiffening feature also increases the mechanical spring rate which minimizes wind-up (the bending of the member caused by contact force) to promote larger snap action displacement characteristics and optimizes the slope of the calibration curve. As shown in FIGS. 5 and 6, the stiffening feature comprises outer marginal edge portions 18*c* on each of the opposed elongated sides which are folded out of the plane in which the remainder of the extended length portion generally lies. The marginal edge portions are shown in FIGS. 5, 6 as being folded 90° toward the high expansion side of the bimetallic member however, if desired, the marginal edge portions may be folded in the opposite direction, i.e., 90° toward the low expansion side of the bimetallic member as shown by bimetallic member 18E in FIG. 14*b*. Further, the degree of folding can be varied, for example, the marginal edge portions can be folded 180° as shown by bimetallic member 18H in FIG. 14*e*. In the FIGS. 1–6 embodiment, the marginal edge portions extend along an imaginary line which is essentially tangent with the outer portion of the circular formed portion 18*a*. A weld slug 22 is attached to bimetallic member 18 closely adjacent to the formed portion 18*a* to minimize thermal creep. Weld slug 22 is used for placement of the bimetallic member in housing member 12. An opening 18*e* is optionally formed in extended length portion 18*b* to increase the current sensitivity of the bimetallic member.

Bimetallic member 18 is cantilever mounted on an indented portion 12*e* of bottom wall 12*a* inside housing member 12 utilizing weld slug 22. The indented portion 12*e* is used to calibrate the bimetallic members actuation temperature within the final assembly with the inner end 12*f* of indented portion 12*e* biasing the bimetallic member and concomitantly the movable contact into engagement with a stationary electrical contact 24 mounted on lid portion 14*b*.

Figure 4:
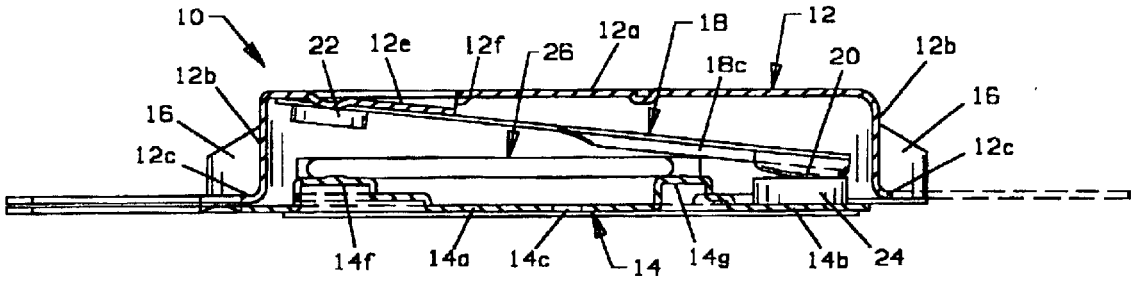
FIG. 4 is a cross sectional view of the FIGS. 1–3 interrupter.
Figure 7:
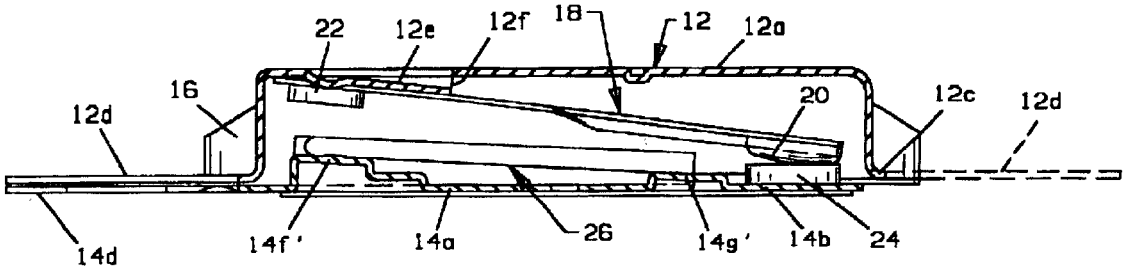
FIG. 7 is a cross sectional view similar to FIG. 4 of a modified circuit interrupter.

As shown in FIG. 4, lid portions 14*a*, 14*b* have deformed land portions 14*f*, 14*g* which provide rigidity to the lid portions and which also serve to mount a heater element 26 in electrical engagement with the respective lid portions and in close thermal relation with bimetallic member 18. Stiffening the housing members allows for the use of thinner materials thereby reducing mass and increasing current sensitivity without increasing the possibility of undesirable recalibration of the device due to the application of external forces incident to handling and the like. In the embodiment shown in FIG. 4, lands 14*f* and 14*g* are approximately the same distance from a plane in which the remainder of the lid portions generally lie. FIG. 7 shows a modified interrupter 10' in which land portion 14*f*' is further from the plane in which the lid portions generally lie than land 14*g*' so that the position of heater 26 more closely parallels that of bimetallic member 18 when it is in the closed contacts position as shown to increase the heat transfer and provide enhanced current sensitivity. Increasing current sensitivity enables the use of a lower resistance device for enhanced locked rotor safety and lowers the voltage drop during normal operation of a motor with which the current interrupter is used thereby resulting in higher torque levels produced by the motor.

When the temperature of bimetallic member 18 increases to an actuation temperature, the member will snap from the closed contacts configuration shown to an oppositely configured open contacts position (not shown) opening the electrical circuit between terminals 12*d*, 14*d*. The extended length portions 18*b* amplifies the translation of form portion 18*a* without requiring modification to the thickness or width of the bimetallic member to achieve similar actuation and reset temperatures.

Figure 14D:
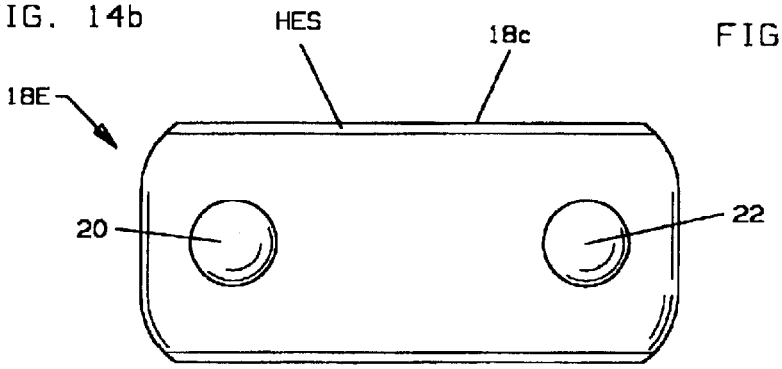
Figure 14E:
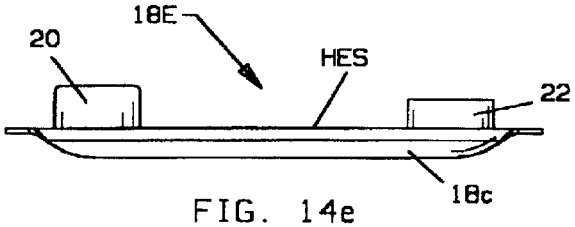
Figure 14F:
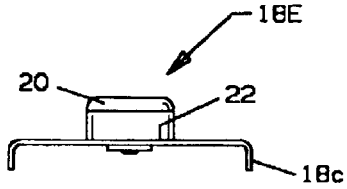
Figure 14G:
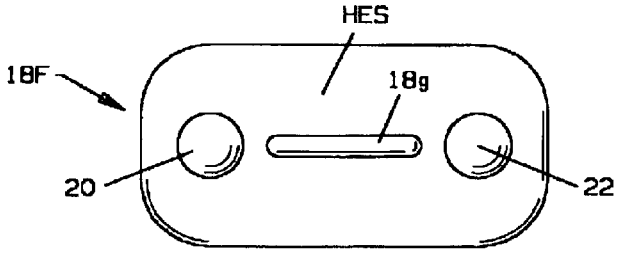
Figure 14H:
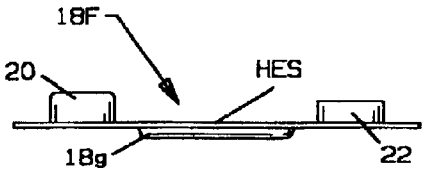
Figure 14I:
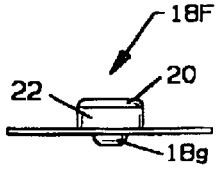
Figure 14J:
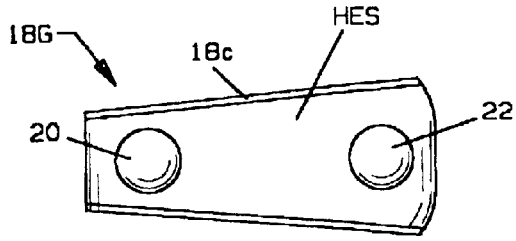
Figure 14K:
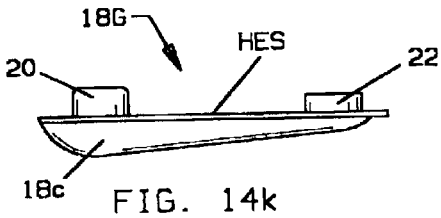
Figure 14L:
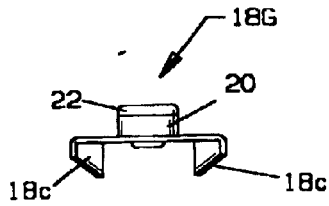
Figure 14M:
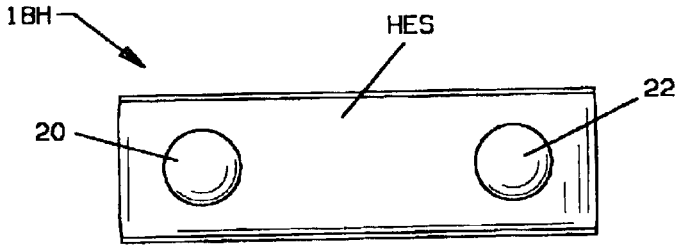
Figure 14N:
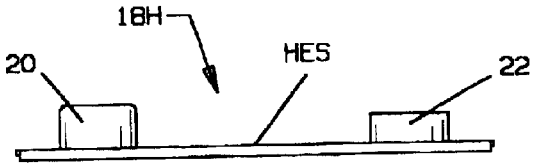

The angled outer marginal edge 18*c* configuration of the bimetallic member 18 shown in FIGS. 5, 6 and by bimetallic member of FIG. 14*d* minimizes the width of the bimetallic member and reduces the mass at the free end thereof for improved dynamic performance during mechanical shock, drop and vibration conditions. In the FIGS. 5, 6 embodiment, this is accomplished by using material inside the maximum form diameter plane to produce the stiffening features.

Figure 8:
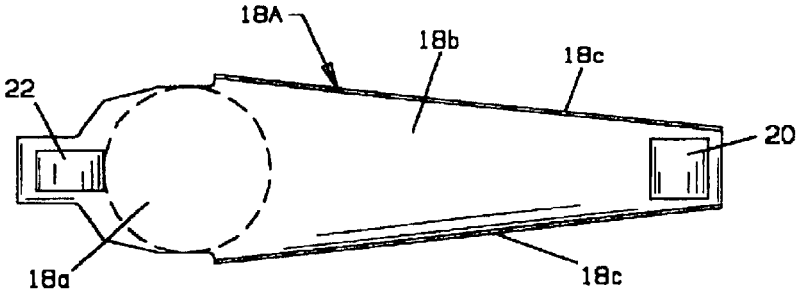
FIGS. 8 and 9 are top plan and front elevational views, respectively, of another form of a bimetallic member useful in the circuit interrupter of the invention.
Figure 9:
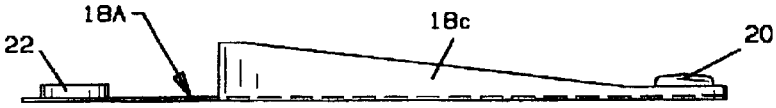
Figure 10:
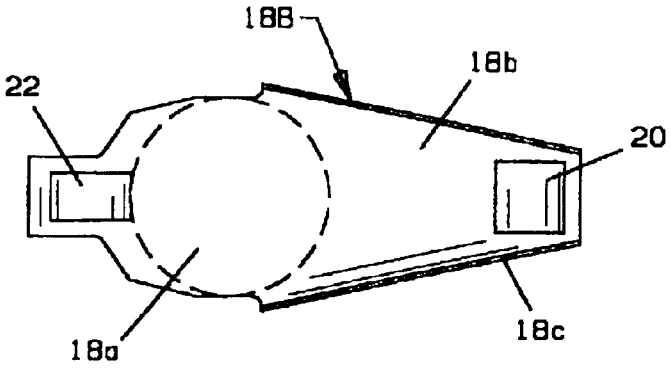
FIGS. 10 and 11 are top plan and front elevational views, respectively, of another form of a bimetallic member useful in the circuit interrupter of the invention.
Figure 11:
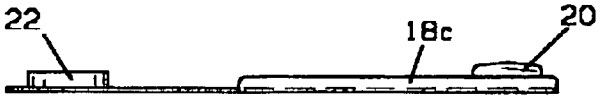
Figure 12:
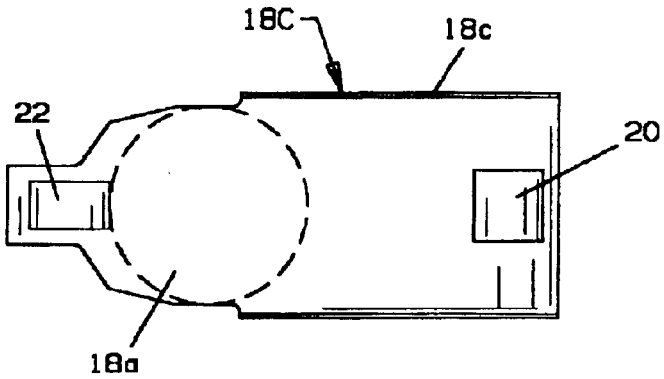
FIGS. 12 and 13 are top plan and front elevational views, respectively, of another form of a bimetallic member useful in the circuit interrupter of the invention.
Figure 13:
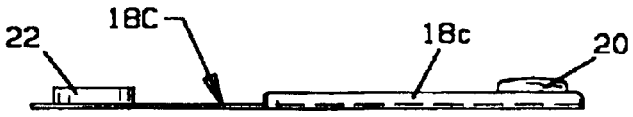
Figure 14O:
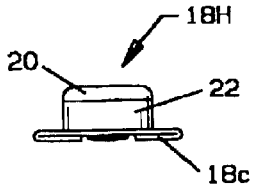

Bimetallic members 18A of FIGS. 8, 9; 18B of FIGS. 10, 11 and 18C of FIGS. 12, 13 show alternative configurations for extended length portions 18*b* and stiffening edge portions 18*c*, which extend outside the maximum formed diameter plane. Still another variation for the stiffening feature is the provision of one or more ribs extending along the length of the extended length portion such as rib 18*g* of bimetallic member 18F of FIG. 14*c*. Bimetallic members 18D, 18E, 18F, 18G and 18H of FIGS. 14*a*–14*o* show several examples of the stiffening feature of the invention relative to the high expansion side (HES) and low expansion side (LES) of the bimetallic members which significantly reduce thermal creep and mechanical wind-up.

Figure 15:
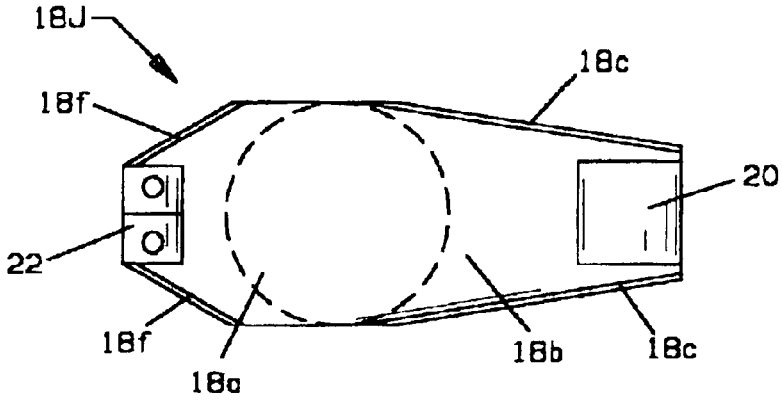
FIGS. 15 and 16 are top and front elevational views, respectively, of another form of a bimetallic member useful in the circuit interrupter of the invention.
Figure 16:
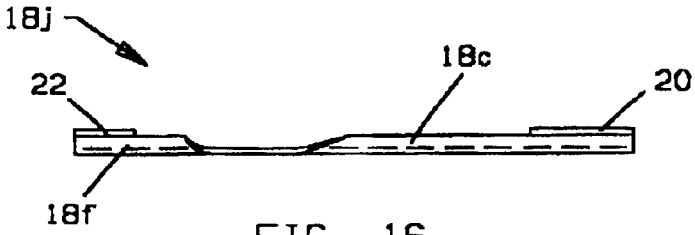

Another preferred embodiment is shown in FIGS. 15 and 16 in which bimetallic element 18J is formed with an extended length portion 18*b* and stiffening edge portions 18*c*, as in the previously described embodiments, but also with similar stiffening edge portions 18*f* on the extended length portion on which weld slug 22 is mounted which extends from formed portion 18*a*. The stiffening feature provided by edge portions 18*f* enhance stiffness of the bimetallic member and further reduces thermal creep.

Figure 17:
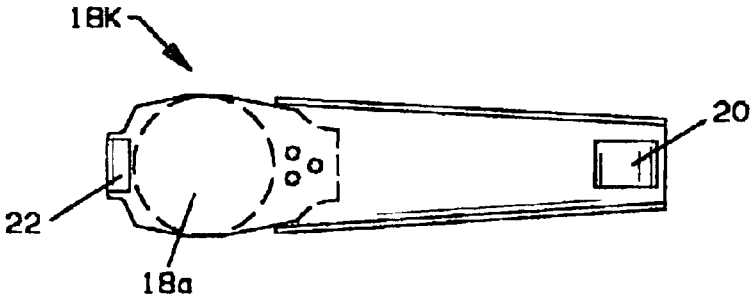
FIGS. 17 and 18 are top and front elevational views, respectively, of a bimetallic member having a monometallic extended length portion useful in the circuit interrupter of the invention.
Figure 18:
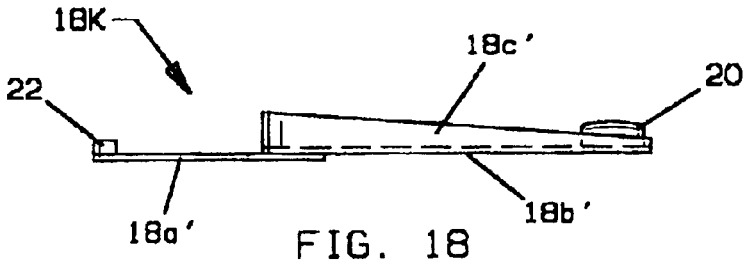

Another alternative embodiment is shown in FIGS. 17 and 18 in which the extended length portion 18*b*' is formed of a suitable monometal, such as stainless steel or cold rolled steel, which is attached to the bimetallic member 18K, as by welding. Stiffening feature 18*c*' increases the mechanical spring rate and reduces wind-up.

Figure 19:
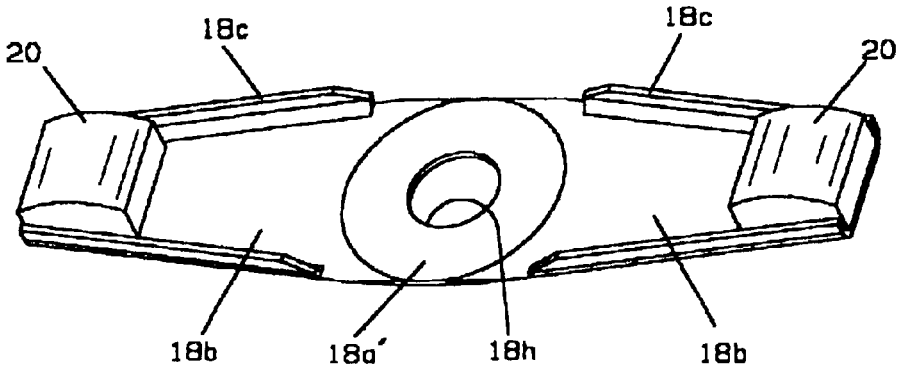
FIG. 19 is a perspective view of a modified bimetallic member having oppositely disposed extended length portions useful in the circuit interrupter of another embodiment of the invention.
Figure 20:
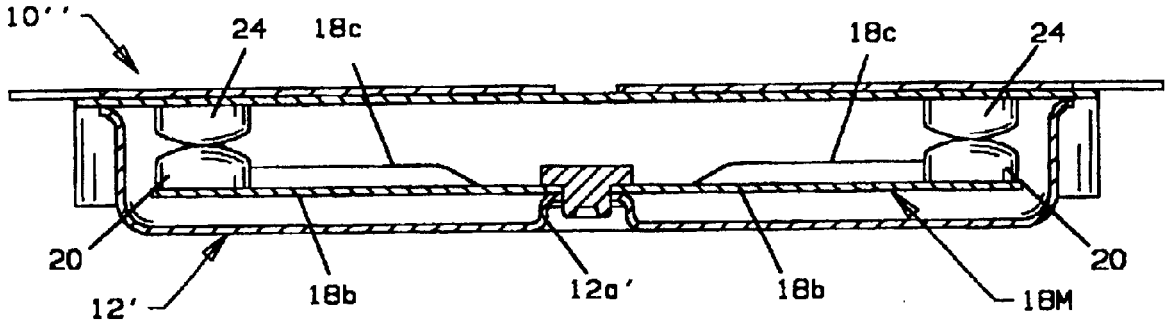
FIG. 20 is a schematic cross sectional view of a circuit interrupter incorporating the FIG. 19 bimetallic member.

It is known that double break contact systems reduce the opening gaps required to extinguish an electric arc in comparison to a single break system. For example, a single break system would require approximately 1.8 mm gap to extinguish an arc of 20 amps at 50 Vdc conditions. In comparison, a double break system requires approximately 0.4 mm per contact pair to extinguish the electric arc for the same conditions thereby significantly reducing the disc and housing size requirements. With reference to FIGS. 19 and 20, a double break current interrupter 10" is shown comprising a bimetallic member 18M having an extended length portion 18*b* on two opposite sides of a formed portion 18*a*'. As in the previously described embodiments, the extended length portions 18*b* are formed with a stiffening feature in the form of folded outer marginal edge portions 18*c* and with a movable contact 20 mounted at the free end of each extended length portion. Bimetallic member 18M is provided with a center hole 18*h* to permanently attach and align the bimetallic member to a rigid structure such as bottom wall 12*a*' of housing member 12', generally to calibrate the bimetallic members actuation temperature within the final assembly. The movable contacts 20 are allowed to move away from mating stationary contacts as member 18M actuates to open the electrical circuit. A formed portion 18*a* is placed in bimetallic member 18M to produce application specific movement, force and actuation temperature characteristics appropriate for the end application. The extended length portions amplify the movement of the form portion without requiring modification to the thickness or width of the bimetallic member to achieve similar actuation and reset temperature. It will be understood that instead of providing hole 18*h*, a weld slug could be used attached to a solid bimetal portion. Further, the bimetallic member, without the hole and even without an attachment feature could be used in a free disc approach, if desired.

Although motor protection has been described as an end use for devices made in accordance with the invention, the invention applies as well as thermostats, circuit breakers and the like. It will be seen that in accordance with the invention, current sensitivity and snap-open contact gap are increased simultaneously by providing a stiffened extended length portion extending beyond the temperature set form portion of a snap-acting bimetallic member.

It should be understood that preferred embodiments of the invention have been described by way of illustrating the invention, but that this invention includes various modifications and equivalents of the disclosed embodiments falling within the scope of the appended claims.

What is claimed:

1. A circuit interrupter comprising a housing member formed of electrically conductive material having a bottom wall and sidewalls forming an opening, a lid member formed of electrically conductive material received on the sidewalls of the housing member electrically separated therefrom, a stationary electrical contact mounted on the lid member, terminals attached to the housing member and the lid member, a member formed of electrically conductive thermostat material, the member having an area deformed to provide snap action between two opposite configurations, the member having an attachment portion mounted to the bottom wall of the housing member and having a generally planar portion extended in length from the deformed area to a distal free end, the extended length portion having a too surface and being formed with at least a part of opposed edge portions extending along the length thereof which are folded out of a plane in which the too surface lies to stiffen the extended length portion to minimize thermal creep, to increase the mechanical spring rate of the extended length portion and to increase snap action movement of the distal free end, and a movable electrical contact mounted on the member at the free distal end thereof adapted to move into and out of electrical engagement with the stationary contact between contacts engaged and disengaged positions in response to the member snapping from one configuration to another in dependence upon selected changes in the temperature of the member, the stiffened extended length portion providing an increased amount of snap action opening between the movable and stationary contacts in the contacts disengaged position.

2. A circuit interrupter according to claim 1 in which the extended length portion is formed of thermostat material integrally formed with the thermostat material member.

3. A circuit interrupter according to claim 1 in which the extended length portion is formed of monometal suitably attached to the member formed of thermostat material.

4. A circuit interrupter according to claim 1 in which the deformed area is generally circular and the attachment portion mounted on the bottom wall of the housing member is beyond the deformed area but contiguous therewith on a side of the deformed area furthest from the extended length portion.

5. A circuit interrupter according to claim 4 further comprising a weld slug mounted on the attachment portion for welding the member of electrically conductive thermostat material to the housing member.

6. A circuit interrupter according to claim 1 in which the at least a part of opposed edge portions are folded generally 90 degrees relative to the top surface to stiffen the extended length portion.

7. A circuit interrupter according to claim 1 in which the at least a part of opposed edge portions are folded generally 180 degrees relative to the top surface to stiffen the extended length portion.

8. A circuit interrupter comprising a housing member formed of electrically conductive material having a bottom wall and sidewalls forming an opening, a lid member formed of electrically conductive material received on the sidewalls of the housing member electrically separated therefrom, a stationary electrical contact mounted on the lid member, terminals attached to the housing member and the lid member, a member formed of electrically conductive thermostat material, the member having an area deformed to provide snap action between two opposite configurations, the member having an attachment portion mounted to the bottom wall of the housing member and having a generally planar portion extended in length from the deformed area to a distal free end, the extended length portion having a top surface being deformed to provide at least one land portion spaced above the remainder of the top surface to stiffen the extended length portion to minimize thermal creep, to increase the mechanical spring rate of the extended length portion and to increase snap action movement of the distal free end, and a movable electrical contact mounted on the member at the free distal end thereof adapted to move into and out of electrical engagement with the stationary contact between contacts engaged and disengaged positions in response to the member snapping from one configuration to another in dependence upon selected changes in the temperature of the member, the stiffened extended length portion providing an increased amount of snap action opening between the movable and stationary contacts in the contacts disengaged position.

9. A circuit interrupter according to claim 1 in which the extended length portion has at least one aperture formed through the top surface to increase current sensitivity of the member of electrically thermostat material.

10. A circuit interrupter according to claim 1 in which the extended length portion is of generally uniform width.

11. A circuit interrupter according to claim 1 in which the extended length portion decreases in width as one goes in the direction from the deformed area to the distal free end.

12. A circuit interrupter according to claim 1 in which the attachment portion is another extended length portion extending from the area deformed to provide snap action, the said another extended length portion being stiffened to further minimize thermal creep and bending of the bimetallic member in the contacts engaged position and increase resonant frequency of the bimetallic member when the contacts are in the contacts disengaged position.

13. Circuit interrupter according to claim 12 in which the said another extended length portion has a top surface and is formed with opposed edge portions extending along the length thereof which are folded out of a plane in which the top surface lies to stiffen the said another extended length portion.

14. A circuit interrupter according to claim 1 in which the lid member is formed of first and second spaced apart portions and further comprising a current carrying heater having two opposite end portions, one of the terminals connected to the first lid portion and the stationary electrical contact connected to the second lid portion and a respective end portion of the heater electrically connected to each lid portion.

15. A circuit interrupter according to claim 14 in which the lid portions are each formed with a heater attachment projection arranged to extend toward the bottom wall of the housing member, the projection on the lid portion mounting the stationary electrical contact extending to a location closer to the bottom wall of the housing member than the other heater attachment projection.

16. A circuit interrupter according to claim 14 in which the lid portions are each formed with a portion being deformed to provide at least one land portion spaced above the remainder of the lid portion to stiffen the lid portion, the at least one land portion serving as a heater attachment projection which extends toward the bottom wall of the housing member, the at least one land portion on the lid portion mounting the stationary electrical contact extending to a location further from the bottom wall of the housing member than the other heater attachment projection.

17. A circuit interrupter according to claim 1 in which the deformed area is generally circular extending the full width of the member and the sides of the extension, after folding, extend along an imaginary line which is essentially tangent with the outer portion of the circular deformed area.

18. A circuit interrupter according to claim 1 in which the deformed area is generally circular extending the full width of the member and the sides of the extension, after folding, have at least a portion wider than the deformed area.

19. A circuit interrupter according to claim 1 in which the member has a second end opposite the free distal end with the deformed area intermediate the free distal end and the second end, and the attachment portion is located generally at the second end.

20. A circuit interrupter according to claim 1 in which the attachment portion of the member is located in the deformed area and the member of electrically conductive thermostat material has a second portion extended in length from the deformed area to a second distal free end with the deformed area intermediate to the two extended length portions, the second extended length portion being stiffened, a second stationary electrical contact mounted on the lid member, and a second movable electrical contact mounted on the member of electrically conductive thermostat material at the second free distal end thereof adapted to move into and out of electrical engagement with the second stationary contact.

21. A circuit interrupter according to claim 20 in which the deformed area is formed with an aperture therethrough for receipt of a mounting member.

22. In a circuit interrupter having a bimetallic switching member having a formed portion to provide snap-acting movement, the bimetallic switching member having at least one movable electrical contact mounted thereon for movement of the movable electrical contact into and out of engagement with a mating stationary electrical contact between a contacts engaged and a contacts disengaged position, the method steps comprising increasing both current sensitivity of the bimetallic switching member and the amount of space between mating electrical contacts when the bimetallic switching member is in the contacts disengaged position by providing a generally planar extended length portion of the bimetallic switching member from the formed portion to a free end of the bimetallic switching member, locating the movable electrical contact at the free end and stiffening the extended length portion by folding at least a portion of proposed marginal edge portions thereof out of a plane in which the remainder of the extended length portion generally lies.

* * * * *